US011192178B2

(12) United States Patent
Kim

(10) Patent No.: US 11,192,178 B2
(45) Date of Patent: Dec. 7, 2021

(54) MOLD

(71) Applicant: SAMSUNG ELECTRONICS CO., LTD., Suwon-si (KR)

(72) Inventor: Sang Baek Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/959,731

(22) PCT Filed: Sep. 14, 2018

(86) PCT No.: PCT/KR2018/010822
§ 371 (c)(1),
(2) Date: Jul. 2, 2020

(87) PCT Pub. No.: WO2019/135465
PCT Pub. Date: Jul. 11, 2019

(65) Prior Publication Data

US 2020/0353535 A1 Nov. 12, 2020

(30) Foreign Application Priority Data

Jan. 3, 2018 (KR) ..... 10-2018-0000648

(51) Int. Cl.
*B22D 17/24* (2006.01)

(52) U.S. Cl.
CPC ..... *B22D 17/24* (2013.01)

(58) Field of Classification Search
CPC ..... B22D 17/20; B22D 17/22; B22D 17/24; B22D 17/2236; B29C 45/2628; B29C 45/36
See application file for complete search history.

(56) References Cited

U.S. PATENT DOCUMENTS 4,452,420 A * 6/1984 Lundquist ..... B29C 33/0033 249/142
4,919,189 A * 4/1990 Sato ..... B22D 17/24 164/137
6,145,578 A * 11/2000 Zearbaugh ..... B22D 17/24 164/340
2004/0159417 A1* 8/2004 Suzuki ..... B22D 17/24 164/113

(Continued)

FOREIGN PATENT DOCUMENTS

JP 04312809 A * 11/1992 ..... B29C 45/2628
KR 10-2007-0002294 A 1/2007
KR 10-2007-0004872 A 1/2007

(Continued)

OTHER PUBLICATIONS

International Search Report dated Jan. 24, 2019 in corresponding International Patent Application No. PCT/KR2018/010822.

*Primary Examiner* — Kevin E Yoon
(74) *Attorney, Agent, or Firm* — Staas & Halsey LLP

(57) ABSTRACT

The present disclosure relates to a mold improved to tune the position of an insert pin for forming a hole in a molded article. The mold includes a core forming a cavity corresponding to a molded article, a forming plate accommodating the core, and an insert pin configured to penetrate the forming plate and the core in a first direction to form a hole in the molded article inside the cavity and be movable along the first direction.

6 Claims, 7 Drawing Sheets

(56) References Cited

U.S. PATENT DOCUMENTS

| | | | | |
|---|---|---|---|---|
| 2012/0263821 | A1* | 10/2012 | Gong | B29C 45/40 425/556 |
| 2018/0133786 | A1* | 5/2018 | Amezawa | B22D 17/2236 |

FOREIGN PATENT DOCUMENTS

| | | | | |
|---|---|---|---|---|
| KR | 101131068 | B1 * | 3/2012 | B22D 17/22 |
| KR | 10-2012-0043568 | A | 5/2012 | |
| KR | 10-2017-0071740 | A | 6/2017 | |
| WO | WO 2010/061437 | A1 | 6/2010 | |

* cited by examiner

MOLD

CROSS-REFERENCE TO RELATED APPLICATIONS

This application is a U.S. National Stage Application which claims the benefit under 35 U.S.C. § 371 of International Patent Application No. PCT/KR2018/010822 filed on Sep. 14, 2018, which claims foreign priority benefit under 35 U.S.C. § 119 of Korean Patent Application No. 10-2018-0000648 filed on Jan. 3, 2018 in the Korean Intellectual Property Office, the contents of both of which are incorporated herein by reference.

TECHNICAL FIELD

The present disclosure relates to a mold improved to tune the position of an insert pin for forming a hole in a molded article.

BACKGROUND ART

In general, a mold may include an injection mold for injecting a molded article, and a press mold for producing a product using an iron plate. A mold may be divided into a movable mold and a fixed mold for smooth production of products.

The injection mold may include a general injection mold for producing a plastic product, a die casting mold for producing a product by melting a metal together with the plastic, and the like.

The injection mold is an apparatus that manufactures a molded article by injecting and curing a molten raw material in a cavity provided therein.

An injection device for injecting a molten raw material into a cavity and a cooling device for supplying a cooling fluid may be connected to the injection mold.

The injection mold may include a pair of cores each including a forming surface of a shape corresponding to one surface of a molded article to be manufactured, and combined with each other to form a cavity corresponding to the molded article to be manufactured.

When a molded article is molded, the molded article may be molded in the cavity as a raw material melted in an injection molding machine is injected into the cavity through a gate in a state where the mold is closed. When the molding of the molded article is completed, the operation in which the closed mold is opened and the molded article is taken out is performed, so that the molding operation may be repeated.

In order to form a hole or the like provided in a molded article, an insert pin installed on a forming plate penetrates the core during molding to enter the cavity, thereby forming the hole or the like, so that the hole or the like may be formed.

When forming a hole, a thin piece-shaped flash in which a raw material flows out from a parting line of a mold or a gap between the insert pin and the core and is solidified or cured may be generated, and thus, in some cases, damage to the insert pin may occur.

Particularly, in a die casting mold, unlike a general plastic injection mold, because the viscosity of aluminum, which is a raw material, is small, when casting, the raw material may spread like water in the mold, aluminum may be molded even in a fine gap generated inside the mold and may remain as a flash.

In general, because a mold may have different shapes for the respective parts and thermal expansion coefficients thereof may be finely different, a flash, which is not generated in an initial stage of injection, may gradually increase as the injection proceeds. As a result, when no action is taken on the mold, the molded article may be mass produced with the flash remaining.

This flash need to be removed from the molded article through processing after forming, and when a part where the flash is generated is a functional part, the molded article may be required to be discarded due to defective dimensions or the like.

DISCLOSURE

Technical Problem

The present disclosure is directed to providing a mold improved to prevent the generation of a flash in a molded article when forming a hole in the molded article through an insert pin installed in the mold.

The present disclosure is directed to providing a mold improved to finely tune the position of an insert pin without further disassembly and assembly of the mold in a state where the mold is suspended from an injection molding machine even during the injection process.

Technical Solution

One aspect of the present disclosure provides a mold including a core forming a cavity corresponding to a molded article, a forming plate accommodating the core, and an insert pin configured to penetrate the forming plate and the core in a first direction to form a hole in the molded article inside the cavity and be movable along the first direction.

The insert pin may include a body portion penetrating the core and a support portion extending from one end of the body portion.

The mold may further include a support member coupled to one side of the support portion to support the insert pin.

The forming plate may include a forming plate insert hole through which the body portion penetrates and an accommodating portion in communication with the forming plate insert hole to accommodate the support portion.

The support member may include a support screw provided on an outer surface thereof to tune the position of the insert pin.

The accommodating portion may include an accommodating screw provided on an inner surface thereof to be screwed with the support screw.

The mold may further include an elastic member disposed on the other side of the support portion to elastically support the insert pin.

The support portion may be disposed between the support member and the elastic member.

The support member may be configured to move the insert pin toward the cavity by being rotated.

The elastic member may be configured to elastically support the insert pin toward the support member.

The support member may further include a tuning portion to which a tuning member configured to rotate the support member is detachably coupled.

The core may include a first core and a second core detachably coupled to the first core, and the position of the insert pin may be tuned such that the insert pin penetrates the first core and comes into contact with the second core inside the cavity.

The mold may further include an eject pin provided to separate the molded article from the cavity and an eject plate to which the eject pin is coupled, wherein the eject plate may include an eject hole provided to allow the tuning member to penetrate therethrough.

The mold may further include an installation plate provided to fix the forming plate, wherein the installation plate may include an installation hole provided to allow the tuning member to penetrate therethrough.

The installation hole, the eject hole, and the tuning portion may be arranged in a line.

Advantageous Effects

A mold according to the present disclosure can prevent the generation of a flash in a molded article when forming a hole in the molded article through an insert pin installed in the mold.

The mold according to the present disclosure can finely tune the position of an insert pin without further disassembly and assembly of the mold in a state where the mold is suspended from an injection molding machine even during the injection process.

MODE OF THE DISCLOSURE

Figure 1:
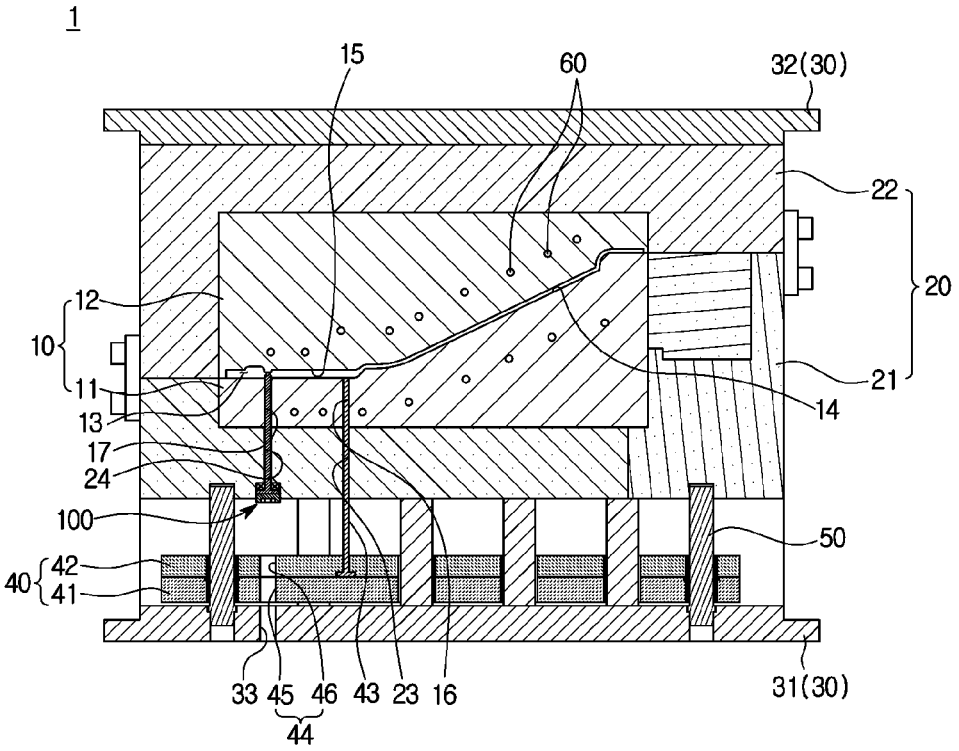
FIG. 1 is a schematic cross-sectional view of a mold according to the present disclosure.

The embodiments described in the present specification and the configurations shown in the drawings are only examples of preferred embodiments of the present disclosure, and various modifications may be made at the time of filing of the present disclosure to replace the embodiments and drawings of the present specification.

Like reference numbers or signs in the various drawings of the application represent parts or components that perform substantially the same functions.

The terms used herein are for the purpose of describing the embodiments and are not intended to restrict and/or to limit the present disclosure. For example, the singular expressions herein may include plural expressions, unless the context clearly dictates otherwise.

The terms "comprises" and "has" are intended to indicate that there are features, numbers, steps, operations, elements, parts, or combinations thereof described in the specification, and do not exclude the presence or addition of one or more other features, numbers, steps, operations, elements, parts, or combinations thereof.

It will be understood that, although the terms first, second, etc. may be used herein to describe various components, these components should not be limited by these terms. These terms are only used to distinguish one component from another.

For example, without departing from the scope of the present disclosure, the first component may be referred to as a second component, and similarly, the second component may also be referred to as a first component. The term "and/or" includes any combination of a plurality of related items or any one of a plurality of related items.

In this specification, the terms "front end," "rear end," "upper portion," "lower portion," "upper end" and "lower end" used in the following description are defined with reference to the drawings, and the shape and position of each component are not limited by these terms.

Hereinafter, embodiments of the present disclosure will be described in detail with reference to the accompanying drawings.

A mold 1 according to the present disclosure may include a die casting mold. However, the present disclosure is not limited thereto.

Figure 2:
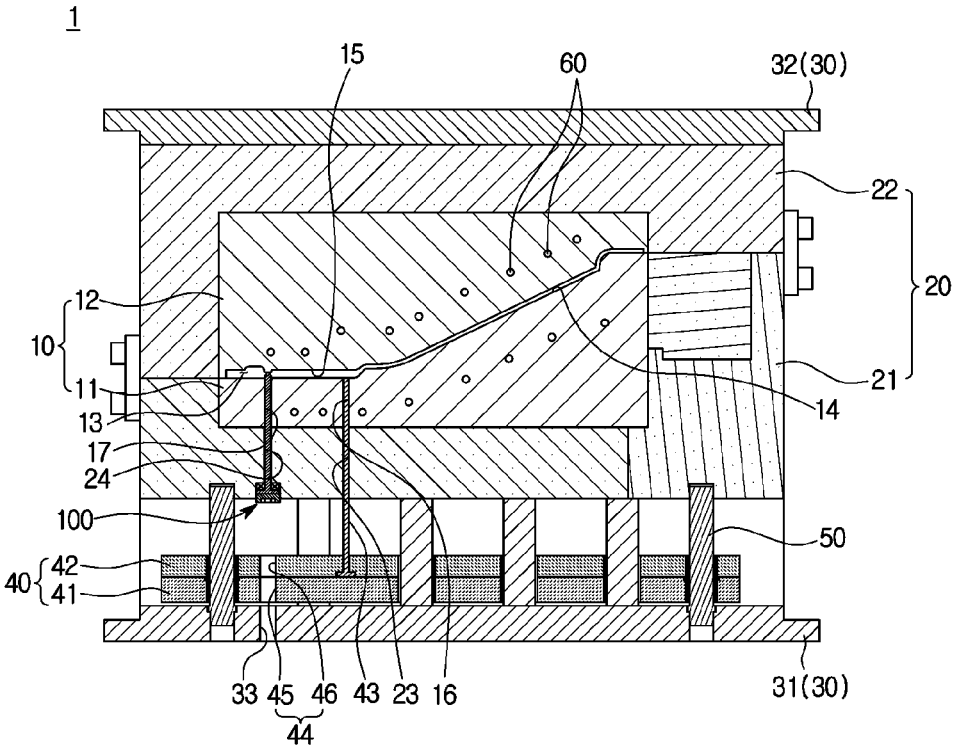
FIG. 2 is a schematic cross-sectional view illustrating that the mold is disassembled according to the present disclosure.
Figure 3:
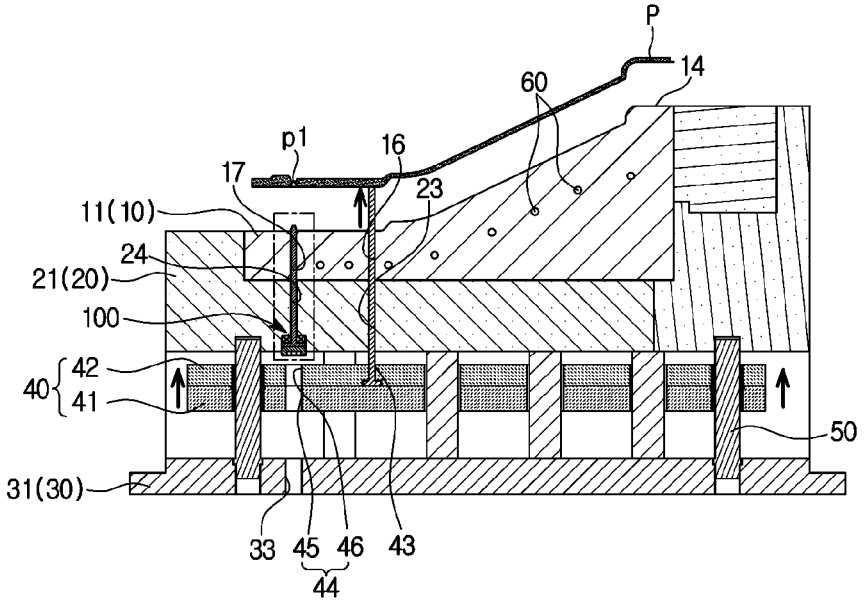
FIG. 3 is a schematic cross-sectional view illustrating an operation in which a molded article is moved by an eject pin in the mold according to the present disclosure.

FIG. 1 is a schematic cross-sectional view of a mold according to the present disclosure. FIG. 2 is a schematic cross-sectional view illustrating that the mold is disassembled according to the present disclosure. FIG. 3 is a schematic cross-sectional view illustrating an operation in which a molded article is moved by an eject pin in the mold according to the present disclosure.

As illustrated in FIGS. 1 to 3, the mold 1 according to the present disclosure may include a core 10 configured to inject a molded article P. The core 10 may include a first core 11 and a second core 12 forming a cavity 13 together with the first core 11 to correspond to a shape of a molded article P to be manufactured.

Although not shown in the drawings, the mold 1 according to the present disclosure may further include devices such as a cooling device (not shown) for supplying a cooling fluid and a transport device (not shown) for moving at least one of the first core 11 and the second core 12.

In the present embodiment, the first core 11 may be fixedly installed, and the second core 12 may be installed to be movable up and down above the first core 11.

Therefore, when the second core 12 moves downward to be coupled to the first core 11, the cavity 13 may be formed, and when the second core 12 moves upward to be separated from the first core 11, the molded article P manufactured in the cavity 13 may be taken out from the mold 1.

Although the present embodiment illustrates that the first core 11 and the second core 12 are arranged vertically, this is for showing an example, and the first core 11 and the second core 12 may be arranged from side to side.

Also, the first core 11 may be moved instead of the second core 12, or both the first core 11 and the second core 12 may be moved.

The first core 11 and the second core 12 may include a first forming surface 14 and a second forming surface 15 having a shape corresponding to one surface of the molded article P to be manufactured, respectively. The first forming surface 14 and the second forming surface 15 may be variously formed, including a curved surface, according to the shape of the molded article P.

In injection molding, when a raw material is injected into the cavity 13, a temperature of the core 10 increases due to a high temperature of the injected raw material, and thus a cooling process for decreasing the temperature of the core 10 increased may be required separately.

Therefore, the mold 1 may receive the cooling fluid such as water through the cooling device (not shown) to cool the core 10 and control a curing speed of the raw material injected into the cavity 13.

The first core 11 and the second core 12 may be provided with cooling passages 60 through which the cooling fluid supplied from the cooling device (not shown) pass, respectively.

The cooling passages 60 may be disposed to be spaced apart from the first forming surface 14 or the second forming surface 15 of the core 10 by a predetermined distance. This is to allow the raw material filled in the cavity 13 to be evenly cooled.

A plurality of the cooling passages 60 may be provided. The cooling passages 60 may be disposed inside the core 10 to correspond to the shape of the molded article P in order to evenly cool the core 10.

In the present embodiment, the cooling passages 60 may be formed in both the first core 11 and the second core 12, but is not limited thereto, and the cooling passages 60 may be formed only in either the first core 11 or the second core 12.

The mold 1 according to the present disclosure may include a forming plate 20 provided to accommodate the core 10 and an installation plate 30 on which the forming plate 20 is installed.

The forming plate 20 may include a first forming plate 21 and a second forming plate 22 detachably coupled to the first forming plate 21. The installation plate 30 may include a first installation plate 31 and a second installation plate 32 disposed to face the first installation plate 31.

The first forming plate 21 may accommodate the first core 11, and the second forming plate 22 may accommodate the second core 12. The first installation plate 31 may be coupled to the first forming plate 21, and the second installation plate 32 may be coupled to the second forming plate 22.

The installation plate 30 may be connected to the transport device (not shown) provided to move the forming plate 20 accommodating the core 10.

The mold 1 may include an eject pin 43 for separating the molded article P cured in the cavity 13 and an eject plate 40 to which the eject pin 43 is coupled.

The eject plate 40 may be provided to be able to reciprocate up and down. Because the eject pin 43 is fixed to the eject plate 40, when the mold 1 is opened, the molded article P in the first core 11 may be pushed and extracted.

The eject plate 40 may be disposed between the first forming plate 21 and the first installation plate 31. The eject plate 40 may include a first eject plate 41 and a second eject plate 42 coupled to the first eject plate 41.

The eject pin 43 may be fixed between the first eject plate 41 and the second eject plate 42. A plurality of the eject pins 43 may be provided. The number and position of the eject pins 43 may be variously provided according to the shape and size of the molded article P.

The core 10 may include a core eject hole 16 formed such that the eject pin 43 penetrates therethrough. The first core 11 may include the core eject hole 16 formed such that the eject pin 43 penetrates therethrough. However, the present disclosure is not limited thereto.

The forming plate 20 may include a forming plate eject hole 23 formed such that the eject pin 43 penetrates therethrough. The first forming plate 21 may include the forming plate eject hole 23 formed such that the eject pin 43 penetrates therethrough. However, the present disclosure is not limited thereto.

The core eject hole 16 and the forming plate eject hole 23 may be in communication. The core eject hole 16 and the forming plate eject hole 23 may be arranged in a line. However, the present disclosure is not limited thereto.

The eject pin 43 may move through the forming plate eject hole 23 and the core eject hole 16 to separate the molded article P from the cavity 13.

The mold 1 may include a guide pin 50 provided to guide the movement of the eject plate 40. The guide pin 50 may connect the first forming plate 21 and the first installation plate 31. A plurality of the guide pins 50 may be provided. However, the present disclosure is not limited thereto.

The mold 1 according to the present disclosure may include an insert pin 100 provided such that a hole p1 is formed in the molded article P inside the cavity 13. The insert pin 100 may penetrate the core 10. The insert pin 100 may penetrate the first core 11. However, the present disclosure is not limited thereto.

The insert pin 100 may be installed in the forming plate 20 to penetrate the forming plate 20. The insert pin 100 may be installed in the first forming plate 21 to penetrate the first forming plate 21. However, the present disclosure is not limited thereto.

Figure 7:
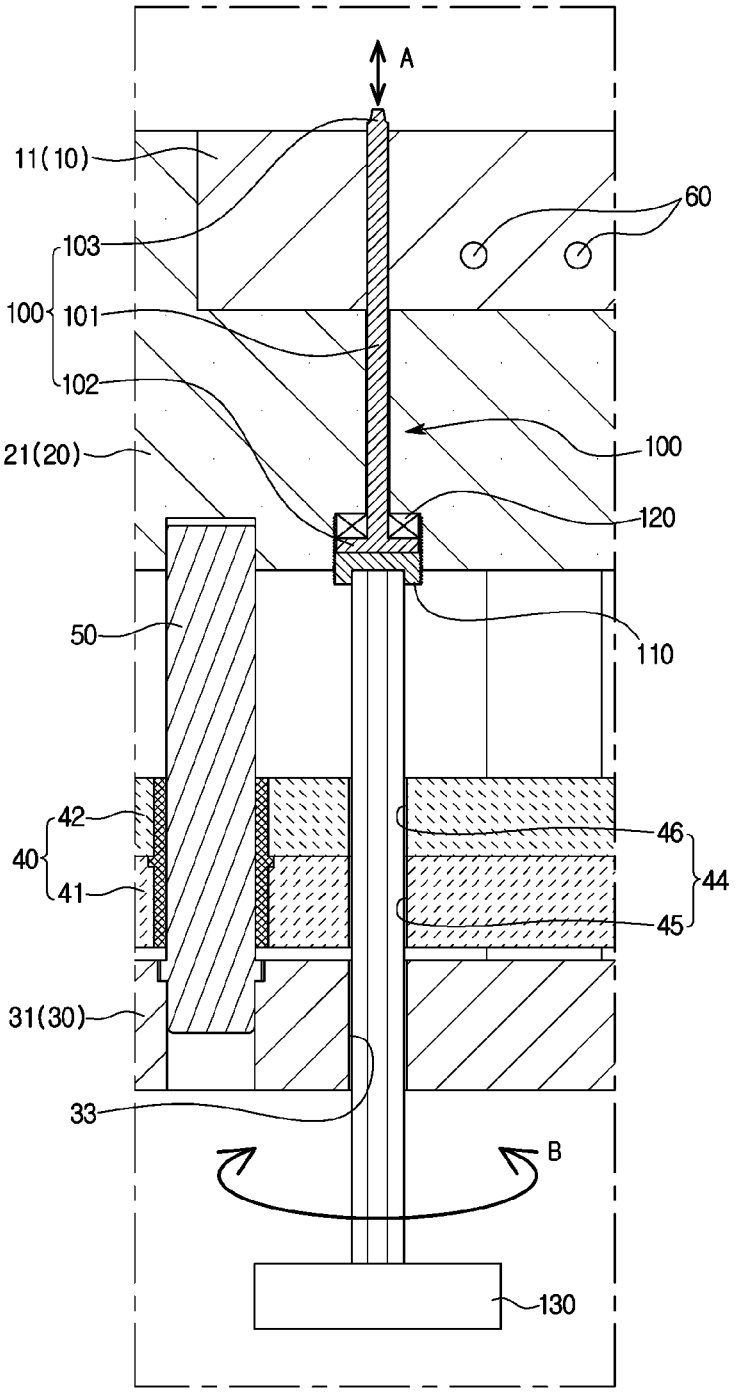
FIG. 7 is a schematic cross-sectional view illustrating an operation in which the insert pin is moved by the tuning member in the mold according to the present disclosure.

The insert pin 100 may penetrate the core 10 or forming plate 20 in a first direction A (see FIG. 7). The first direction A may include all of the up and down directions based on FIG. 7.

The insert pin 100 may be provided movably along the first direction A. That is, the insert pin 100 may be provided movably in a direction toward the cavity 13 or a direction opposite thereto.

A position of the insert pin 100 may be tuned by a tuning member 130 (see FIG. 6) inserted from the outside of the mold 1 into the inside of the mold 1. A detailed description of the movement of the insert pin 100 will be given later.

The core 10 may include a core insert hole 17 formed such that the insert pin 100 penetrates therethrough. The first core 11 may include the core insert hole 17 formed such that the insert pin 100 penetrates therethrough. However, the present disclosure is not limited thereto.

The forming plate 20 may include a forming plate insert hole 24 formed such that the insert pin 100 penetrates therethrough. The first forming plate 20 may include the forming plate insert hole 24 formed such that the insert pin 100 penetrates therethrough. However, the present disclosure is not limited thereto.

The core insert hole 17 and the forming plate insert hole 24 may be in communication. The core insert hole 17 and the forming plate insert hole 24 may be arranged in a line. However, the present disclosure is not limited thereto.

The insert pin 100 may form the hole p1 in the molded article P that is molded inside the cavity 13 by moving through the forming plate insert hole 24 and the core insert hole 17.

The eject plate 40 may include an eject hole 44 formed such that the tuning member 130 penetrates therethorugh. The first eject plate 41 may include a first eject hole 45 formed such that the tuning member 130 penetrates therethorugh. The second eject plate 42 may include a second eject hole 46 formed such that the tuning member 130 penetrates therethorugh.

The first eject hole 45 and the second eject hole 46 may be in communication. The first eject hole 45 and the second eject hole 46 may be arranged in a line. However, the present disclosure is not limited thereto.

The installation plate 30 may include an installation hole 33 formed such that the tuning member 130 penetrates therethorugh. The first installation plate 31 may include the installation hole 33 formed such that the tuning member 130 penetrates therethorugh.

The installation hole 33 and the eject hole 44 may be in communication. The installation hole 33 and the eject hole 44 may be arranged in a line. However, the present disclosure is not limited thereto.

Figure 4:
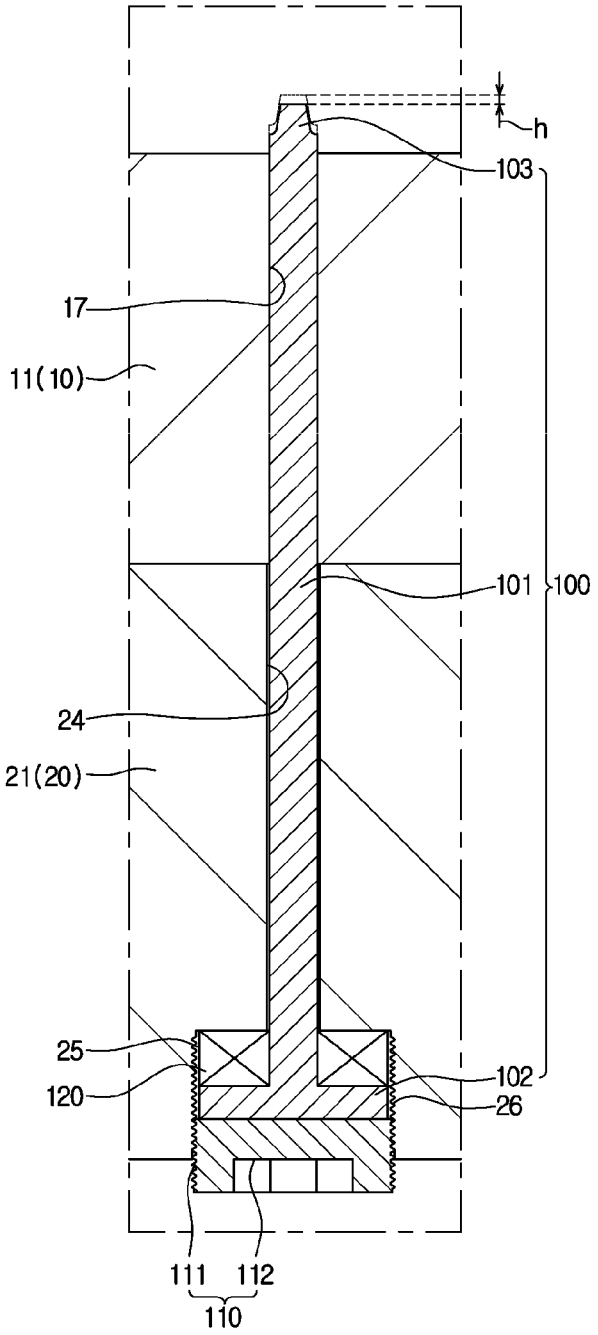
FIG. 4 is a schematic cross-sectional view illustrating that an insert pin is combined in the mold according to the present disclosure.
Figure 5:
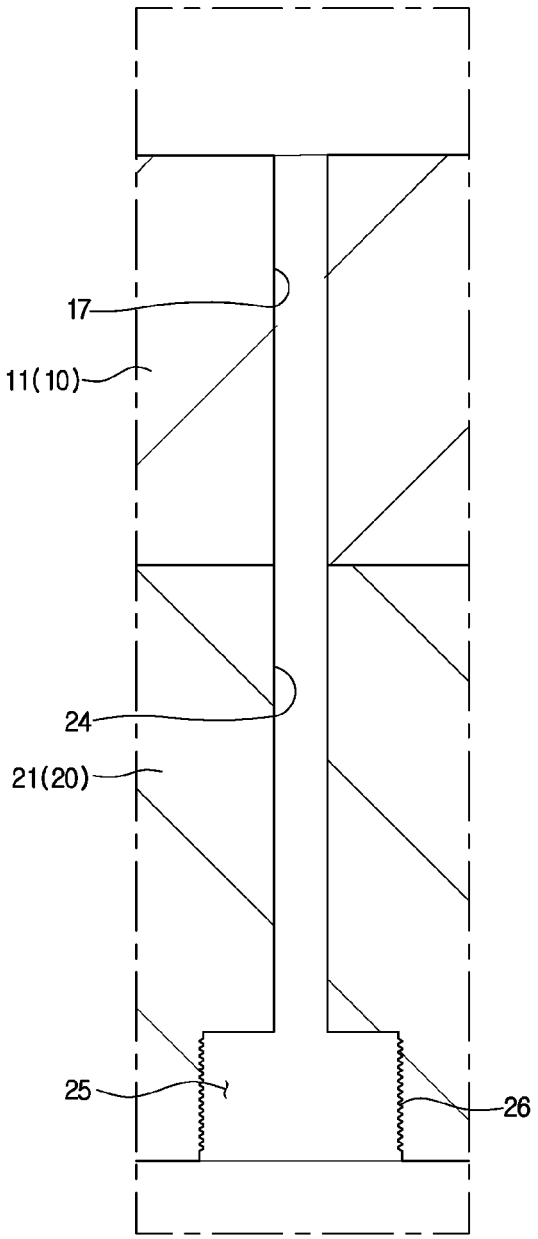
FIG. 5 is a schematic cross-sectional view illustrating that the insert pin is removed in the mold according to the present disclosure.

FIG. 4 is a schematic cross-sectional view illustrating that an insert pin is combined in the mold according to the present disclosure. FIG. 5 is a schematic cross-sectional view illustrating that the insert pin is removed in the mold according to the present disclosure.

As illustrated in FIGS. 4 and 5, the insert pin 100 may include a body portion 101 penetrating the core 10 and a support portion 102 extending from one end of the body portion 101. The support portion 102 may be bent from one end of the body portion 101.

The body portion 101 may penetrate the first core 11. The body portion 101 may penetrate the forming plate 20. The body portion 101 may penetrate the first forming plate 21. However, the present disclosure is not limited thereto.

The insert pin 100 may be inserted into the first core 11 or the first forming plate 21. The body portion 101 may be inserted into the core insert hole 17 or the forming plate insert hole 24.

The insert pin 100 may include a hole forming portion 103 extending from one end of the body portion 101. The hole forming portion 103 may form the hole p1 in the molded article P molded inside the cavity 13 (see FIG. 1).

When forming the hole p1, a thin piece-shaped flash in which a raw material flows out from a gap between the core 10 and the insert pin 100 and is solidified or cured may be generated.

Particularly, in the case of a die casting mold, unlike a general plastic injection mold, because the viscosity of aluminum, which is a raw material, is small, when casting, the raw material may spread like water in the mold 1, aluminum may be molded even in a fine gap generated inside the mold 1 and may remain as a flash. This flash need to be removed from the molded article P through processing after forming, and when a part where the flash is generated is a functional part, the molded article P itself may be required to be discarded due to defective dimensions or the like.

Therefore, in order to prevent the flash from being generated in advance, the hole forming portion 103 of the insert pin 100 located inside the cavity 13 through the first core 11 is required to be in contact with the second core 12.

That is, the hole forming portion 103 and the second core 12 need to be in close contact with each other so that a gap through which a raw material such as aluminum may flow does not occur between the hole forming portion 103 and the second core 12.

Because the mold 1 has different shapes for the respective parts and thermal expansion coefficients thereof may be finely different, the flash, which is not generated in an initial stage of injection by forming the hole forming portion 103 in close contact with the second core 12 without any gap, may occur by a gap generated between the hole forming portion 103 and the second core 12 as the injection proceeds.

That is, the flash is generated by the raw material flowing between the hole forming portion 103 and the gap between the second core 12 and gradually increases, and as a result, when no action is taken on the mold 1, the molded article P may be mass produced with the flash remaining.

As such, when the flash is generated in the molded article P as a gap is formed between the hole forming portion 103 and the second core 12, the flash may be removed by tuning the position of the insert pin 100 such that the hole forming portion 103 is in close contact with the second core 12 again not to allow the gap between the hole forming portion 103 and the second core 12 to be generated.

However, in general, when the position of the insert pin 100 needs to be tuned, it is required to disassemble the mold 1 to separate the insert pin 100 from the core 10 and the forming plate 20, machine or replace the insert pin 100, and then assemble the mold 1 again.

However, in the mold 1 according to the present disclosure, the position of the insert pin 100 may be finely tuned while the mold 1 is suspended from an injection molding machine (not shown) without disassembly and assembly of the mold 1 even during injection.

Therefore, the insert pin 100 of the mold 1 according to the present disclosure may have a predetermined movement distance h along the first direction A (see FIG. 7).

The forming plate 20 may include an accommodating portion 25 in communication with the forming plate insert hole 24 to accommodate the support portion 102. The accommodating portion 25 may be provided at one end of the forming plate 20. The accommodating portion 25 may include a groove.

The mold 1 may include a support member 110 coupled to one side of the support portion 102 to support the insert pin 100. The support member 110 may be disposed below the support portion 102.

The support member 110 may support the insert pin 100 in a direction toward the cavity 13 so that the insert pin 100 does not deviate from the accommodating portion 25. The support member 110 may press one side of the insert pin 100 toward the cavity 13 to tune the position of the insert pin 100.

The support member 110 may include a support screw 111 configured to tune the position of the insert pin 100. The support screw 111 may be provided on an outer surface of the support member 110. The support screw 111 may include threads.

The accommodating portion 25 may include a receiving screw 26 provided to which the support screw 111 is screwed. The receiving screw 26 may be disposed on an inner surface of the accommodating portion 25. The receiving screw 26 may include threads.

The support member 110 may include a set screw such as a headless bolt. However, the present disclosure is not limited thereto. A portion of the support member 110 may protrude to the outside of the accommodating portion 25.

The mold 1 may include an elastic member 120 disposed on the other side of the support portion 102 to elastically support the insert pin 100. The elastic member 120 may include a spring. A plurality of the elastic members 120 may be provided. However, the present disclosure is not limited thereto.

The elastic member 120 may be disposed above the support portion 102. The elastic member 120 may be disposed to surround a circumference of the body portion 101. The support portion 102 may be disposed between the support member 110 and the elastic member 120.

The elastic member 120 may be configured to elastically support the insert pin 100 toward the support member 110. The elastic member 120 may press the other side of the insert pin 100 toward the support member 110 to elastically support the insert pin 100.

The elastic member 120 may press the insert pin 100 in the opposite direction to a direction in which the insert pin 100 faces the cavity 13 (see FIG. 1). Therefore, the support member 110 and the elastic member 120 may press the insert pin 100 in opposite directions at opposite sides of the support portion 102 according to the first direction A, respectively.

The support member 110 may include a tuning portion 112 to which the tuning member 130 configured to rotate the support member 110 is detachably coupled. The tuning portion 112 may include a groove provided to insert the tuning member 130.

The support member 110 may be configured to move the insert pin 100 toward the cavity 13 by being rotated. The installation hole 33, the eject hole 44 and the tuning portion 112 may be arranged in a line. However, the present disclosure is not limited thereto.

Figure 6:
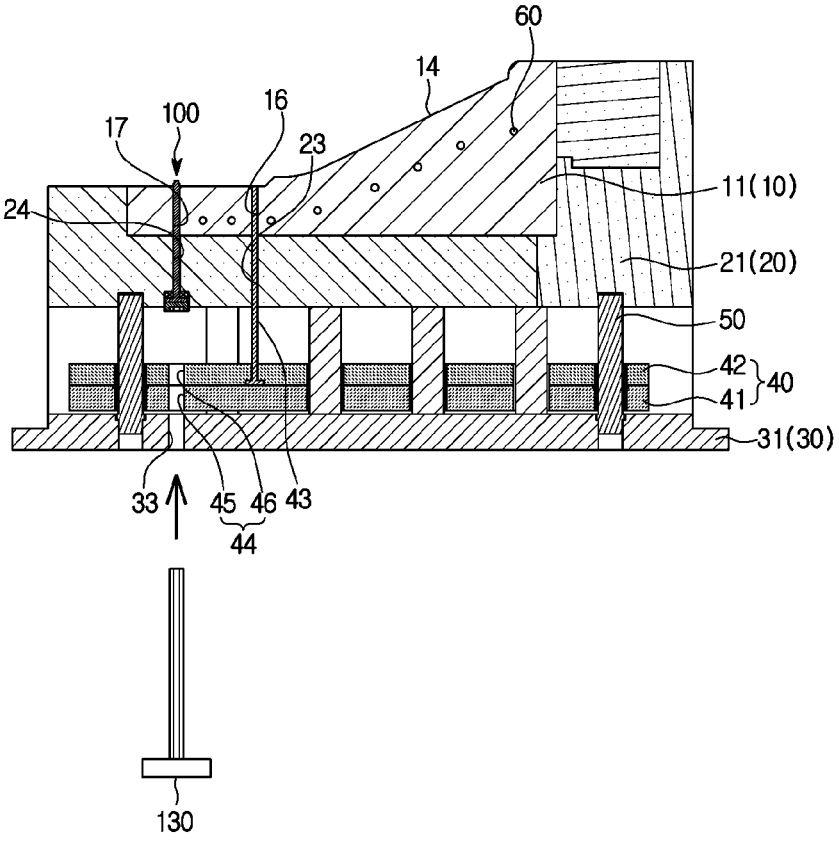
FIG. 6 is a schematic cross-sectional view illustrating an operation in which a tuning member is inserted in the mold according to the present disclosure.

FIG. 6 is a schematic cross-sectional view illustrating an operation in which a tuning member is inserted in the mold according to the present disclosure. FIG. 7 is a schematic cross-sectional view illustrating an operation in which the insert pin is moved by the tuning member in the mold according to the present disclosure.

As illustrated in FIGS. 6 and 7, the mold 1 (see FIG. 1) according to the present disclosure may include the tuning member 130 provided to tune the position of the insert pin 100. The tuning member 130 may finely tune the position of the insert pin 100 without disassembling the mold 1.

Hereinafter, a method of tuning the position of the insert pin 100 through the tuning member 130 will be described in detail.

In the initial stage of injection through the mold 1 according to the present disclosure, the hole forming portion 103 (see FIG. 4) of the insert pin 100 and the second forming surface 15 (see FIG. 2) of the second core 12 are in close contact with each other, and thus there is no gap through which the raw material may flow, so that a flash may not be generated in the hole p1 (see FIG. 3) of the molded article P (see FIG. 3).

However, a gap may be generated between the hole forming portion 103 of the insert pin 100 and the second forming surface 15 of the second core 12 during the continuous injection process, and the raw material may flow into the generated gap to generate a flash in the hole p1 of the molded article P.

In this case, according to the mold 1 of the present disclosure, the position of the insert pin 100 may be tuned without disassembling the mold 1 to come the hole forming portion 103 of the insert pin 100 into close contact with the second forming surface 15 of the second core 12 again to eliminate the gap formed therebetween. That is, the user may finely tune the position of the insert pin 100 in the mold 1 suspended from the injection molding machine (not shown) by a simple method through the tuning member 130.

First, the user inserts the tuning member 130 into the installation hole 33 of the first installation plate 31 and then inserts the tuning member 130 along the eject hole 44 of the eject plate 40, so that the tuning member 130 may be coupled to the support member 110.

That is, the tuning member 130 may have a predetermined length so as to be coupled to the support member 110 by penetrating the installation hole 33 and the eject hole 44.

The tuning member 130 may be engaged with the tuning portion 112 (see FIG. 4) provided at a lower portion of the support member 110. For example, the tuning portion 112 and one end of the tuning member 130 coupled to the tuning portion 112 may include a hexagonal shape, and the tuning member 130 may be engaged with the inside of the tuning portion 112. However, the present disclosure is not limited thereto.

The tuning member 130 coupled to the tuning portion 112 is rotated along a second direction B to rotate the support member 110, and the support screw 111 provided on the support member 110 and the accommodating screw 26 provided on the accommodating portion 25 are spirally rotated, so that the support member 110 may be moved along the first direction A.

Herein, the second direction B may include a clockwise or counterclockwise direction.

As the support member 110 moves along the first direction A, the insert pin 100 coupled to the support member 110 may be moved along the first direction A so that the position thereof may be tuned.

Through this, the position of the insert pin 100 may be finely tuned to eliminate the gap between the hole forming portion 103 of the insert pin 100 and the second forming surface 15 of the second core 12.

Also, when the hole forming portion 103 of the insert pin 100 excessively presses the second forming surface 15 of the second core 12, the position of the insert pin 100 may be finely tuned in the direction opposite to a direction in which the hole forming portion 103 of the insert pin 100 presses the second forming surface 15 of the second core 12.

While the present disclosure has been particularly described with reference to exemplary embodiments, but the scope of rights of the present disclosure is not limited to these embodiments.

Various embodiments that may be modified or modified by those skilled in the art of the present disclosure would also be within the scope of the present disclosure, without departing from the gist of the present disclosure specified in the claims.

The invention claimed is:

1. A mold comprising:

a core forming a cavity corresponding to a molded article;

a forming plate accommodating the core;

an insert pin configured to penetrate the forming plate and the core in a first direction to form a hole in the molded article inside the cavity and be movable along the first direction, the insert pin comprising a body portion penetrating the core and a support portion extending from one end of the body portion;

a support screw coupled to one side of the support portion to support the insert pin; and an elastic member disposed above the support portion to elastically support the insert pin toward the support screw, wherein the forming plate comprises a forming plate insert hole through which the body portion penetrates and an accommodating portion in communication with the forming plate insert hole to accommodate the support portion, wherein the elastic member is provided inside the accommodating portion and is disposed to surround at least a portion of a circumference of the body portion, and wherein the support portion is disposed between the support screw and the elastic member, wherein the support screw further comprises a tuning portion to which a tuning member configured to rotate the support screw, is detachably coupled, wherein an eject pin is provided to separate the molded article from the cavity and the eject pin is coupled to an eject plate, wherein the eject plate comprises an eject hole provided to allow the tuning member to penetrate therethrough, and wherein a guide pin disposed through the eject plate to guide the eject plate as it moves along the guide pin.

2. The mold according to claim 1, wherein the accommodating portion comprises an accommodating screw provided on an inner surface thereof to be screwed with the support screw.

3. The mold according to claim 1, wherein the support screw is configured to move the insert pin toward the cavity by being rotated.

4. The mold according to claim 1, wherein the core comprises a first core and a second core detachably coupled to the first core, and the position of the insert pin is tuned such that the insert pin penetrates the first core and comes into contact with the second core inside the cavity.

5. The mold according to claim 1, further comprising an installation plate provided to fix the forming plate, wherein the installation plate comprises an installation hole provided to allow the tuning member to penetrate therethrough.

6. The mold according to claim 5, wherein the installation hole, the eject hole, and the tuning portion are arranged in a line.

* * * * *